US005553707A

United States Patent [19]

Lion

[11] Patent Number: 5,553,707

[45] Date of Patent: Sep. 10, 1996

[54] GOLF BALL HOLDING DEVICE

[76] Inventor: Ronald K. Lion, 375 Summit Rd., Watsonville, Calif. 95076

[21] Appl. No.: 541,614

[22] Filed: Oct. 10, 1995

[51] Int. Cl.[6] ..... B65D 85/58

[52] U.S. Cl. ..... 206/315.9; 206/459.5; 206/511; 206/512; 211/14; 211/86; 224/667; 224/677; 224/678; 224/666

[58] Field of Search ..... 206/579, 315.9, 206/459.5, 315.91, 509–512; 211/14, 15, 86; 224/252

[56] References Cited

U.S. PATENT DOCUMENTS

| | | | |
|---|---|---|---|
| 1,718,952 | 7/1929 | Fischer | 206/315.9 |
| 2,226,670 | 12/1940 | Pratt et al. | 206/511 |
| 3,497,676 | 2/1970 | Gravatt | 224/252 |
| 3,777,933 | 12/1973 | Joliot | 211/15 |
| 3,980,215 | 9/1976 | Schwarzbauer | 206/315.9 |
| 4,077,514 | 3/1978 | Kubokawa | 206/316.9 |
| 4,299,345 | 11/1981 | Lanzl | 224/252 |
| 4,730,728 | 3/1988 | Larkin | 224/252 |
| 5,183,154 | 2/1993 | Slemp | 206/315.9 |
| 5,379,892 | 1/1995 | Reams et al. | 206/315.9 |
| 5,480,026 | 1/1996 | Darling et al. | 206/315.9 |

*Primary Examiner*—Jimmy G. Foster
*Attorney, Agent, or Firm*—Jeffrey A. Hall

[57] ABSTRACT

A portable container for golf balls including three elongated elements, each of the three elongated elements having a top end and a bottom end. The container includes a base having a top face, a bottom face, a front side, and a rear side; the base being secured to the bottom end of each of the three elongated elements. A top element having a top face, a bottom face, a front side, and a rear side is secured to the top end of each of the three elongated elements. A plurality of dimples and corresponding cavities are used for securing together a plurality of the portable containers for golf balls. A clip for fastening to a belt or other object may be secured to one of the three elongated elements for detachably securing the portable container for golf bails to an animate or inanimate object.

10 Claims, 2 Drawing Sheets

GOLF BALL HOLDING DEVICE

BACKGROUND OF THE INVENTION

1. Field of Invention

This invention relates to holding devices for golf balls, and particularly to holding devices for golf balls which are portable and may be secured to a belt or a golf bag.

2. Description of the Related Art

Various containers and holding devices have been proposed and implemented to house and transport articles such as balls. Although a large variety of containers and related holders have been developed, there does not exist a holder or container for golf balls which is convenient to load or unload with balls or which is easily secured to a user's belt, golf bag, or other item. Prior ball holders, such as tennis ball cans, or display holders for various balls such as basketballs, footballs, and the like are adequate for their intended purpose, however, they are inadequate for holding balls such as golf balls, especially during play.

The closest known device to applicant, as disclosed in U.S. Pat. No. 1,718,952 and issued to Fischer on Jul. 2, 1929, shows a holder for golf balls which was designed to hold golf balls in a golf bag, was cumbersome and inefficient, and did not address the problem of providing a potable container which may be worn by the user, for example on his or her belt. Such attempts are representative of prior, albeit incomplete solutions to such problems and such significant limitations to prior devices have undoubtedly been a reason such devices have not received widespread acceptance.

Accordingly, it is the primary object of this invention to provide a golf ball holding device for holding, carrying, packaging and dispensing golf balls which is portable, stackable, convenient to attach or remove from a belt, golf bag, pocket, or the like, which is easy and convenient to use, lightweight, inexpensive to manufacture, and which retains the balls in a secure yet visible position.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out in the appended claims.

SUMMARY OF THE INVENTION

To achieve the foregoing objects, and in accordance with the purpose of the invention as embodied and broadly described herein, a portable container for golf balls is provided, comprising: three elongated elements, each of the three elongated elements having a top end and a bottom end. A base element having a top face, a bottom face, a front side, and a rear side; the base being secured to the bottom end of each of the three elongated elements. A top element having a top lace, a bottom face, a front side, and a rear side; the top being secured to said top end of each of said three elongated elements. Means for securing together a plurality of said portable containers for golf balls may be provided. The means for securing together a plurality of the portable containers for golf balls being preferably positioned and secured on the base and top. Means for detachably securing the portable container for golf balls to an animate or inanimate object are also provided. The means for detachably securing the portable container for golf balls being preferably secured on one of the three elongated elements.

The holding device and container for golf balls of the present invention may be used with other types of balls such as tennis balls, hockey pucks, basketballs, pool balls, volleyballs, table tennis balls, baseballs and the like. Preferably the three elongated elements are secured and spaced at one hundred and twenty degree angles from one another on said base thereby forming a triangular enclosure for holding golf balls. In one preferred configuration two of the three elongated elements are cylindrically configured and one of the three elongated elements has a flattened configuration. Means for securing together a plurality of the containers may comprise a plurality of dimples positioned on the top of the holding device and a corresponding plurality of cavities positioned on the bottom face of the base. A clip or other fastening means may be used to attach the holding device to a belt or other object.

BRIEF DESCRIPTION OF THE DRAWINGS

The accompanying drawings, which are incorporated in and constitute a part of the specification, illustrate a preferred embodiment of the invention and, together with a general description given above and the detailed description of the preferred embodiment given below, serve to explain the principles of the invention.

DESCRIPTION OF THE PREFERRED EMBODIMENTS

Reference will now be made in detail to the present preferred embodiments of the invention as illustrated in the accompanying drawings.

In accordance with the present invention, there is provided a portable holder for golf balls, comprising three elongated elements, each of the three elongated elements having a top end and a bottom end. A base having a top face, a bottom face, a front side, and a rear side; the base being secured to the bottom end of each of the three elongated elements. A top element having a top face, a bottom face, a front side, and a rear side; the top being preferably secured to the top end of each of the three elongated elements. Means for securing together a plurality of the portable containers for golf balls may comprise a plurality of dimples and corresponding cavities, tongue and groove elements, or other fastening means such as clips for securing together a plurality of the portable holders for golf balls. Means for detachably securing the portable container for golf balls to an animate or inanimate object may comprise a clip, hook, or loop secured to an elongated element and adapted to receive and secure a belt or other object.

Figure 1:
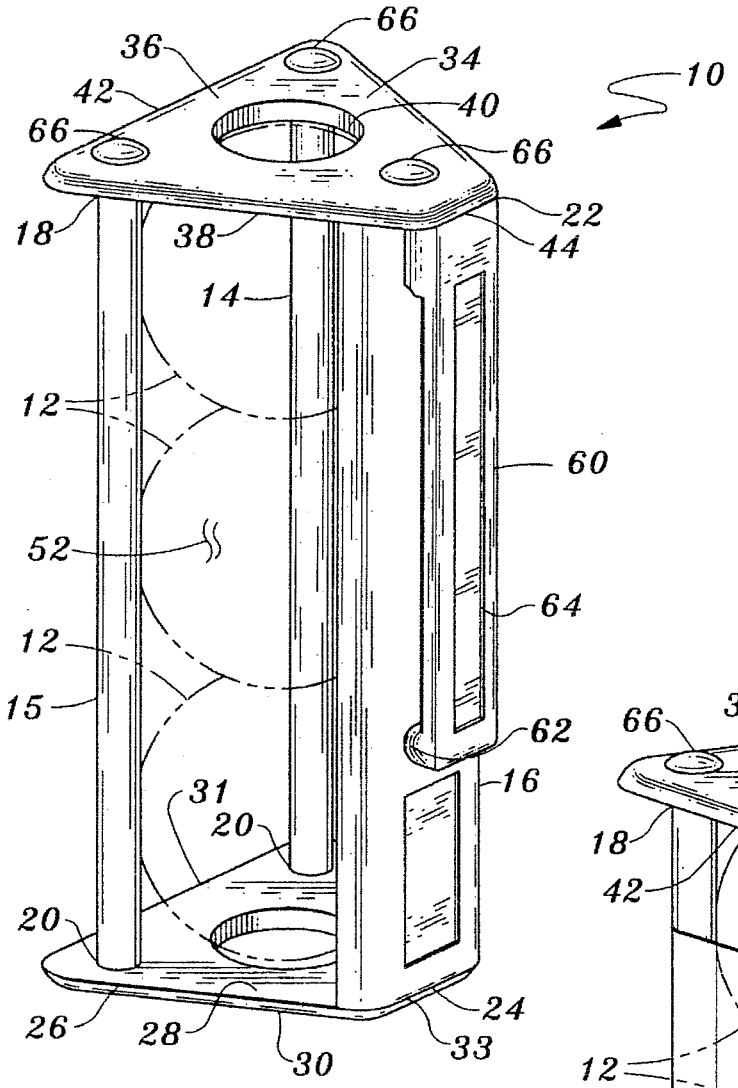
FIG. 1 is a side perspective view of such holding device for golf balls, according to the invention.
Figure 2:
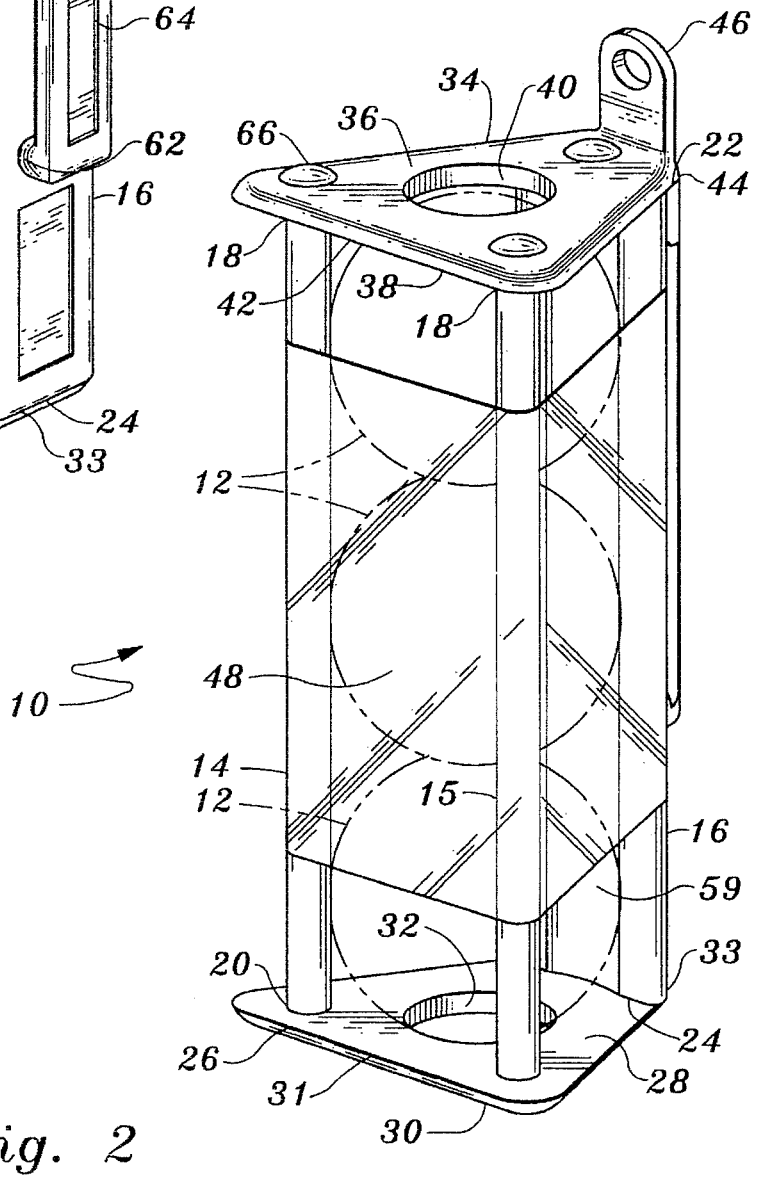
FIG. 2 is a front perspective view of a holding device for golf balls with holding loop, according to the invention.
Figure 4:
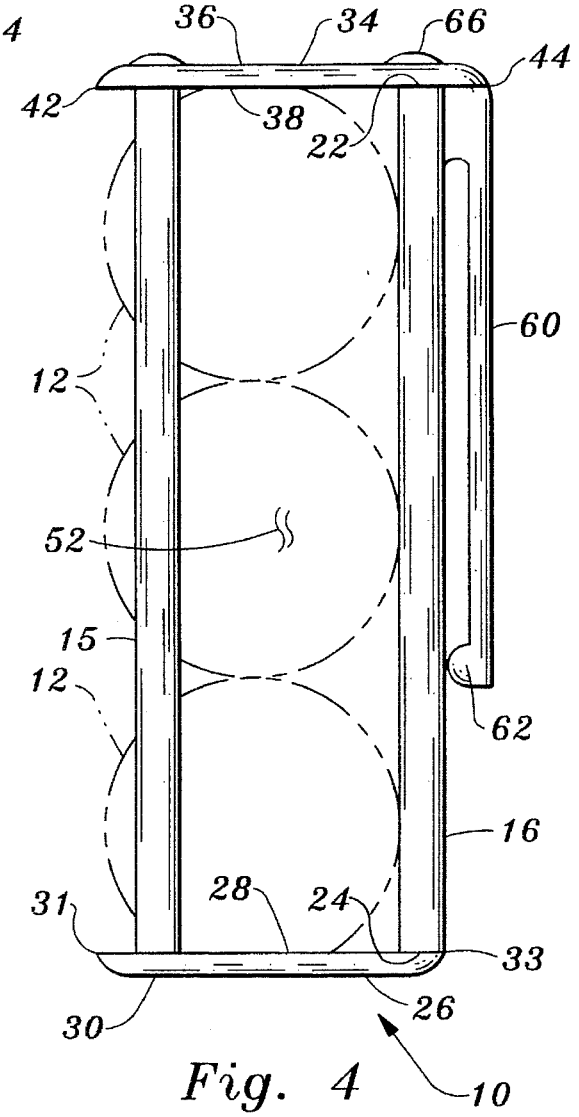
FIG. 4 is a rear view of such holding device for golf balls, according to the invention.
Figure 5:
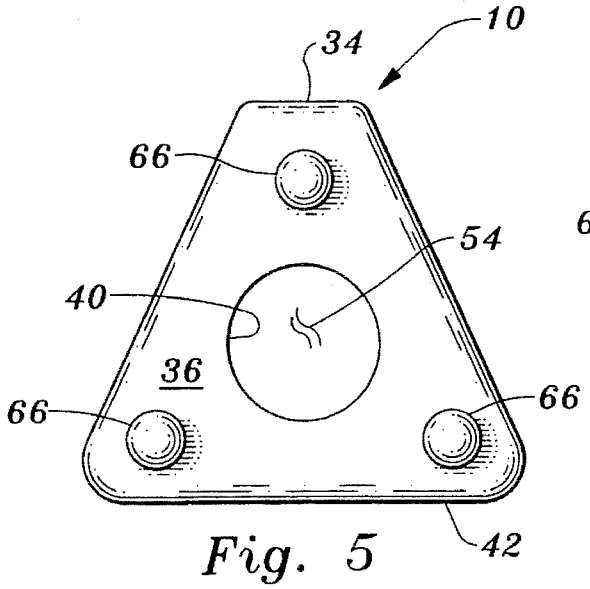
FIG. 5 is a top view showing stacking dimples, according to the invention
Figure 6:
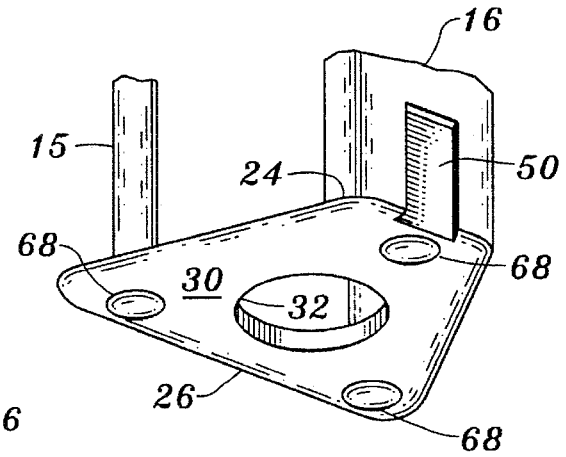
FIG. 6 is a perspective view of tongue and groove stacking means for such holding device for golf balls, according to an embodiment of the invention.

In FIGS. 1 and 2, the holding device for golf balls 10 is shown with sleeve 48 attached in FIG. 2. However, holding device 10 may be utilized with or without sleeve 48. Holding device 10 is portable and comprises, in the preferred embodiment three elongated elements 14, 15, and 16, however four elongated elements may also be used. Preferably elements 14 and 15 are cylindrically configured and element 16 is flattened with a substantially planar profile. However, element 16 may be cylindrical as well. Alternatively, elements 14, 15 and 16 may be provided in different configurations such as rectangulary shaped or other geometric configurations. Elements 14, 15, and 16 are secured to a base 26 having a top face 28, a bottom face 30, a front side 31 and a rear side 33. An aperture 32 may be included in base 26 as seen in FIGS. 1 and 2. Alternatively, hook or loop 46 may be provided as seen in FIG. 2 with corresponding groove 50 providing stacking means and seen in FIG. 4 in one embodiment of the invention.

Elongated elements 14, 15 include top ends 18 and bottom end 20, bottom end 20 being secured to base 26. Elongated element 16 has top end 22 and bottom end 24, with bottom end 24 being secured to base 26, and may have inner wall 59 being slightly curved as seen in FIGS. 1 and 2. A top element 34 with a top face 36, a bottom face 38, a front side 42, a rear side 44, and an optional aperture 40 secures and positions the top ends 18 and 22 of elements 14, 15 and 16. Top element 34 may include stacking dimples 66 to mate with corresponding cavities 68 in the bottom face 30 of base 26. In the preferred embodiment, the three elongated elements 14, 15 and 16 are positioned and spaced at 120 degrees apart from one another creating a substantially triangular internal space 54 for holding golf balls 12. This spacing provides a triangular shape enclosure for golf balls 12 while space 52 between elongated elements 14, 15, and 16 allow for the easy removal of golf ball 12. In the preferred embodiment, holding device 10 is sized to hold three golf balls with space 52 between elements 14 and 15 being sized to allow the removal of golf balls therethrough and not through the space between elements 14 and 16 or the space between element 15 and 16. However, in alternative embodiments this may be changed with the space between elements 14 and 16 and the space between elements 15 and 16 being sized to allow removal of golf balls. In alternative embodiments holding device 10 may be sized to hold more than three golf balls or less as desired.

The three elongated elements 14, 15 and 16 as well as base 26 and top 34 are preferably composed of a durable resilient material such as plastic, rubber, thermoplastic or the like, and as previously mentioned, spaced so as to form a triangular holding space for balls. This results from choosing three points equidistant around the periphery of a ball with a triangular space formed with any one side or space being smaller than the diameter of the ball. This is critical to the present invention as the elongated elements are preferably constructed of a resilient, flexible material which will spread apart when the ball is pushed between any two of them and then will all contact the ball at three points when the ball is positioned in the center of the three elongated elements.

With reference now to FIGS. 1 and 2, elongated element 16 is shown, according to one embodiment of the invention with a substantially rectangular configuration and a clip 60 mounted thereon. Of course, element 16 may be configured differently, such a cylinder, triangle, or other geometric configuration. Also seen in FIG. 1 is clip 60 with protrusion 62 and flattened area 64 for decals or trademarks which may be operably secured to elongated element 16. Clip 60 is used for carrying ball holding device 10 on a user's belt. Alternatively, clip 60 could be eliminated, and if the user wants to secure ball holding device to his or her belt, the belt could simply be threaded through space 52 and rest against elongated element 16.

Figure 3:
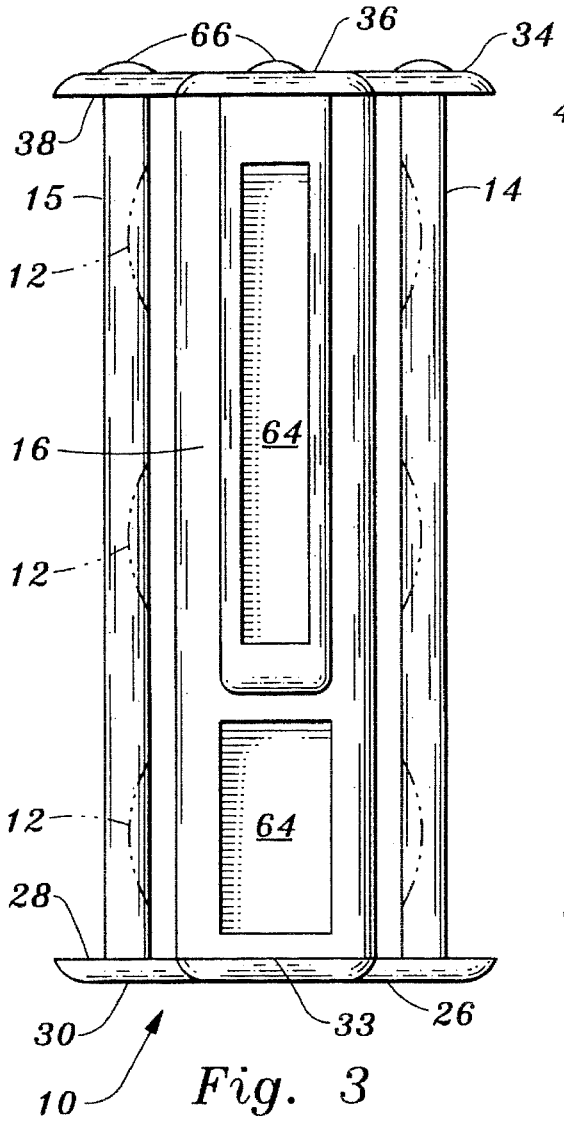
FIG. 3 is a left side view of such holding device for golf balls, according to the invention.

In FIG. 3 space 52 between elongated elements 14, 15, and 16 allows for the placement and removal of golf ball 12 from holder 10. Elements 14, 15 are resilient and flexible and may be spread apart allowing golf ball 12 to be removed from holder 10. Of course, for different application, such as for different sized balls such as tennis balls the spacing of elongated elements 14, 15 and 16 will be changed, however, their angular relationship will remain the same. Of course, while the three elongated elements 14, 15, and 16 are preferably spaced as described so as to form a substantially triangular enclosure 54, deviations from this configuration may be practiced without departing from the spirit or scope of the present invention. For example, if elongated elements 14 and 15 were positioned so that internal space 54 deviates from a triangular configuration a working holding device could still be fashioned, albeit, less satisfactory than the preferred embodiment as herein described. Similarly, if more than three elongated elements are used, such as four, five, or more, thereby creating different configurations of internal space 54 and thereby changing the shape of the space between bars 52, a ball holding device would be achieved within the scope of the present invention, however, it would be less satisfactory than the preferred embodiment as herein described.

In operation and use ball holding device 10 is extremely convenient and useful. The user may easily remove or insert golf balls into space 54. If desired, the user may attach device 10 to a belt or golf bag, or if storage or display of balls is desired device 10 may be conveniently stored and stacked.

Additional advantages and modification will readily occur to those skilled in the art. The invention in its broader aspects is, therefore, not limited to the specific details, representative apparatus and illustrative examples shown and described. Accordingly, departures from such details may be made without departing from the spirit or scope of the applicant's general inventive concept.

What is claimed is:

1. A portable container for golf balls, comprising;

three elongated elements, each of said three elongated elements having a top end and a bottom end;

a base having a top face, a bottom face, a front side, and a rear side; said base being secured to said bottom end of each of said three elongated elements; the three elongated elements being positioned in relation to one another on said so as to form a triangular enclosure;

a top having a top face, a bottom face, a front side, and a rear side; said top being secured to said top end of each of said three elongated elements;

means for securing together a plurality of said portable containers for golf balls; said means for securing together a plurality of said portable containers for golf balls being positioned on said base and said top; and means for detachably securing the portable container for golf balls to an animate or inanimate object; said means for detachably securing the portable container for golf balls being secured on one of said three elongated elements.

2. The portable container for golf balls of claim 1, wherein said three elongated elements are secured and spaced at one hundred and twenty degree angles from one another on said base thereby forming a triangular enclosure for holding golf balls.

3. The portable container for golf balls of claim 1, wherein two of said three elongated elements are cylindrically configured and one of said three elongated elements has a flattened configuration.

4. The portable container for golf balls of claim 3, wherein said means for securing together a plurality of said containers comprises a plurality of dimples positioned on said top and a corresponding plurality of cavities on said base allowing for the base of a said portable container to be secured to a top of a different portable container.

5. The portable container for balls of claim 1, wherein said means for detachably securing the portable container for golf balls comprises a clip for receiving a belt.

6. The portable container for golf balls of claim 1, wherein said bottom is triangularly configured.

7. The portable container for golf balls of claim 1, wherein said top is triangularly configured.

8. The portable container for golf balls of claim 1, further including a flexible sleeve secured to said three elongated elements.

9. The portable container for golf balls of claim 1, wherein said three elongated elements are composed of plastic.

10. The portable container for golf balls of claim 1, wherein two of said three elongated elements moveable and flexible.

* * * * *